US011811157B2

(12) United States Patent
Schnell et al.

(10) Patent No.: US 11,811,157 B2
(45) Date of Patent: Nov. 7, 2023

(54) PRINTED CIRCUIT BOARD EDGE CONNECTOR

(71) Applicant: Dell Products L.P., Round Rock, TX (US)

(72) Inventors: Arnold Thomas Schnell, Hutto, TX (US); Ahsan Habib, Round Rock, TX (US); Man Tak Ho, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 70 days.

(21) Appl. No.: 17/653,374

(22) Filed: Mar. 3, 2022

(65) Prior Publication Data

US 2023/0282999 A1 Sep. 7, 2023

(51) Int. Cl.
*H01R 12/72* (2011.01)
*H01R 12/73* (2011.01)
*H01R 43/26* (2006.01)

(52) U.S. Cl.
CPC ..... *H01R 12/721* (2013.01); *H01R 12/732* (2013.01); *H01R 43/26* (2013.01)

(58) Field of Classification Search
CPC ..... H01R 12/721; H01R 12/732; H01R 43/26
USPC ..... 439/59
See application file for complete search history.

(56) References Cited

U.S. PATENT DOCUMENTS 8,057,263 B1 * 11/2011 Howard ..... H01R 12/721 439/631
8,075,343 B2 * 12/2011 Fu ..... H01R 12/732 439/328
8,123,534 B1 * 2/2012 Herring ..... H01R 12/721 439/328
8,282,402 B2 * 10/2012 Ngo ..... H01R 13/6273 439/79
8,550,854 B2 * 10/2013 Okano ..... H01R 12/7082 439/631
8,597,056 B2 * 12/2013 Blanchfield ..... H01R 12/721 439/630

(Continued)

FOREIGN PATENT DOCUMENTS

CN 102437460 A * 5/2012 ..... H01R 12/7082
CN 202363616 U * 8/2012 ..... H01R 12/7011

(Continued)

*Primary Examiner* — Peter G Leigh
(74) *Attorney, Agent, or Firm* — McDermott Will & Emery LLP

(57) ABSTRACT

An edge connector for coplanar coupling of two printed circuit boards (PCBs) comprises an elongated body and two end structures. The elongated body has a compression contact space and two PCB contact surfaces, each PCB contact surface having a plurality of contact positions. Portions of compression contacts positioned in the compression contact space extend through contact positions on both PCB contact surfaces. When a PCB edge surface contacts a PCB contact surface of the elongated body, an edge connection on the PCB edge surface contacts a compression contact, forming an electrical connection. Each end structure has two contact pairs, wherein each contact pair has attaching features that couple the edge connector to a PCB to maintain the electrical connection. When two PCBs are coupled to the edge connector, the compression contacts form electric paths for conducting power and/or communication between the two PCBs.

18 Claims, 12 Drawing Sheets

(56) References Cited

U.S. PATENT DOCUMENTS

| | | | | |
|---|---|---|---|---|
| 10,637,175 | B1 * | 4/2020 | Zou | H01R 12/7088 |
| 10,873,146 | B2 * | 12/2020 | Zou | H01R 12/721 |
| 11,081,823 | B2 * | 8/2021 | Zhang | H01R 13/113 |
| 2011/0151701 | A1 * | 6/2011 | Ngo | H01R 12/732<br>439/327 |
| 2013/0005190 | A1 * | 1/2013 | Blanchfield | H01R 12/721<br>439/629 |

FOREIGN PATENT DOCUMENTS

| | | | | | |
|---|---|---|---|---|---|
| CN | 202363704 | U | * | 8/2012 | H01R 12/7052 |
| CN | 208939193 | U | * | 6/2019 | |
| DE | 102011001486 | A1 | * | 9/2012 | H01R 12/721 |

* cited by examiner

PRINTED CIRCUIT BOARD EDGE CONNECTOR

BACKGROUND

Field of the Disclosure

This disclosure relates generally to printed circuit board assemblies and, more particularly, to systems for edge-to-edge connection of adjacent printed circuit boards.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An information handling system contains printed circuit boards (PCBs), wherein the size, shape and layout of a PCB may depend on components installed on the PCB, the dimensions of the chassis and user perception.

SUMMARY

Embodiments disclosed herein may be generally directed to printed circuit board assemblies (PCAs) having two printed circuit boards (PCBs) connected edge-to-edge, and particularly to an edge connector for edge-to-edge connection of two PCBs.

Embodiments disclosed herein may be directed to an edge connector for coplanar coupling of two printed circuit boards (PCBs) into a printed circuit board assembly (PCA). An edge connector may comprise an elongated body with a compression contact space, referred to herein as a compression contact space, and two PCB contact surfaces including a first PCB contact surface and a second PCB contact surface, wherein the first PCB contact surface is opposite the second PCB contact surface. A plurality of contact positions are formed lengthwise along the elongated body, wherein a first set of the plurality of contact positions is on the first PCB contact surface and a second set of the plurality of contact positions is on the second PCB contact surface. A plurality of resilient compression contacts are positioned in the compression contact space, wherein each compression contact comprises conductive material and is configured to provide compression force against each of the two PCBs coupled to the edge connector.

Embodiments of an edge connector further comprise end structures with contact pairs, wherein each contact pair comprises a top contact and a bottom contact that couple the two PCBs to the edge connector. Top contacts extending in a first direction contact the first PCB on predefined PCB pads and top contacts extending in a second direction towards the second PCB contact the second PCB on predefined PCB pads. Bottom contacts extending in the first direction contact the first PCB on predefined PCB pads and bottom contacts extending in the second direction towards the second PCB contact the second PCB on predefined PCB pads. The top contacts and bottom contacts form first and second contact pairs on the first end structure. The top contacts and bottom contacts form first and second contact pairs on the second end structure. The first and second contact pairs on the first end structure and the first and second contact pairs on the second end structure couple the edge connector to both PCBs as the edge connector spans across the space between the two PCBs.

In some embodiments, the top and bottom contacts are separated a fixed distance and have a range of motion and spring force to accommodate a multitude of PCB thicknesses while still maintaining sufficient contact force for a proper electrical interface.

In some embodiments, each of the top and bottom contacts are interlocked to a PCB by an engaging feature for coupling to a receiver in the top and bottom surfaces of the PCB. In some embodiments, a PCB design includes receiver features that define and control the engagement of the edge connector with the PCB. In some embodiments, a PCB comprises a through-hole forming the receiver in the first surface and the receiver in the second surface, wherein the top contact of each contact pair is configured for positioning an engaging feature in the through-hole and the bottom contact of each contact pair is configured for positioning an engaging feature in the through-hole.

BRIEF DESCRIPTION OF THE DRAWINGS

For a more complete understanding of the invention and its features and advantages, reference is now made to the following description, taken in conjunction with the accompanying drawings, in which.

DESCRIPTION OF PARTICULAR EMBODIMENT(S)

Figure 1:
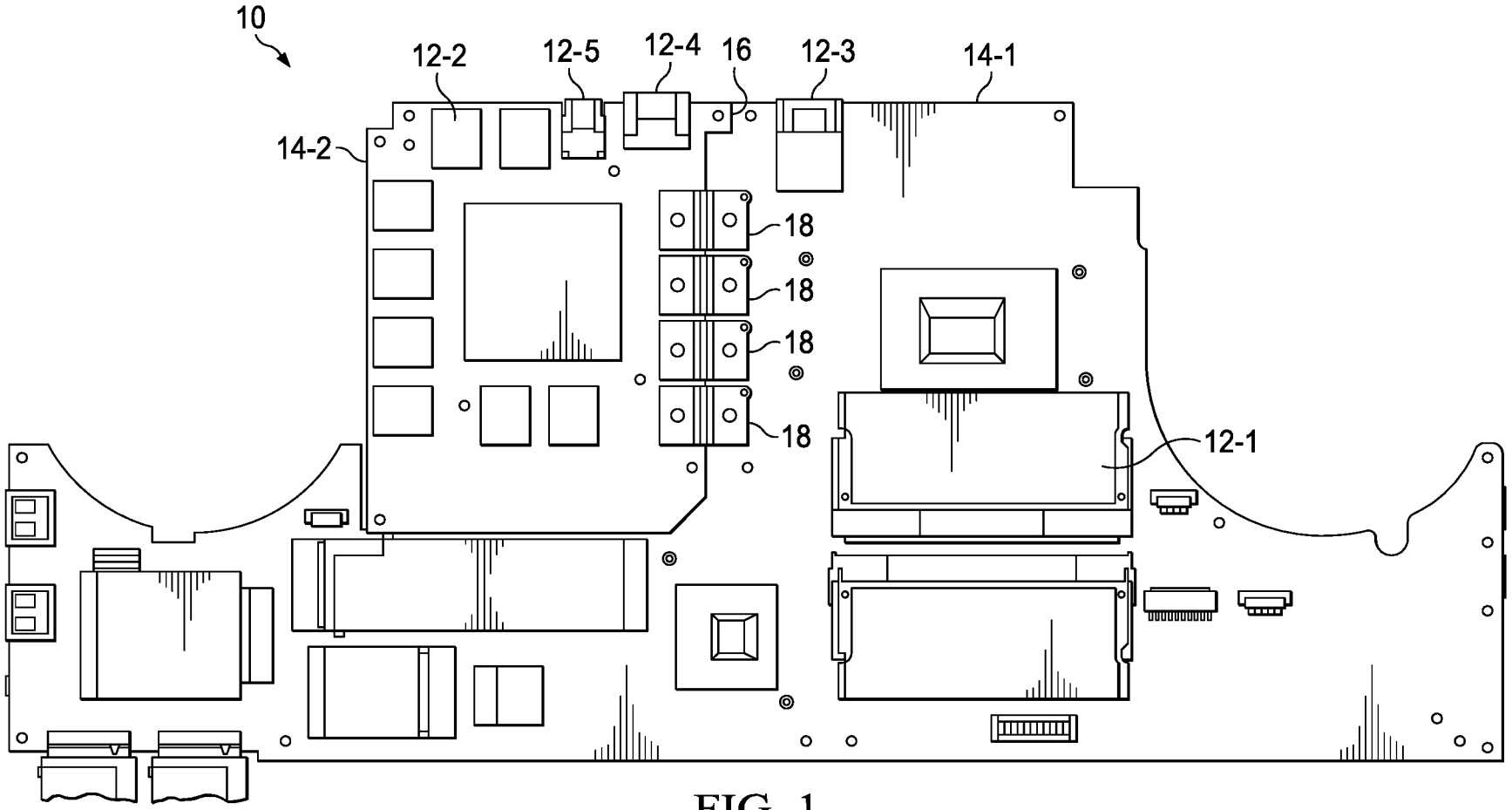
FIG. 1 is a top view of two PCBs coupled with compression connectors to form a PCA for use in an information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, PCB "14-1" refers to an instance of a PCB, which may be referred to collectively as PCBs "14" and any one of which may be referred to generically as PCB "14." Also, for ease of understanding, the terms "top" and "bottom" may be used for describing relative positions in the drawings, but embodiments may be configured in any orientation.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and one or more video displays. The information handling system may also include one or more buses operable to transmit communication between the various hardware components.

Components of an information handling system may include, but are not limited to, a processor subsystem, which may comprise one or more processors, and a system bus that communicatively couples various system components to processor subsystem including, for example, a memory subsystem, an I/O subsystem, local storage resource, and network interface.

A processor subsystem may comprise a system, device, or apparatus operable to interpret and execute program instructions and process data, and may include a microprocessor, microcontroller, digital signal processor (DSP), application specific integrated circuit (ASIC), or another digital or analog circuitry configured to interpret and execute program instructions and process data. In some embodiments, components of a processor subsystem may interpret and execute program instructions and process data stored locally (e.g., in a memory subsystem). In the same or alternative embodiments, components of a processor subsystem may interpret and execute program instructions and process data stored remotely (e.g., in a network storage resource).

A system bus may refer to a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

A memory subsystem may comprise a system, device, or apparatus operable to retain and retrieve program instructions and data for a period of time (e.g., computer-readable media). Components of a memory subsystem may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling systems, an I/O subsystem may comprise a system, device, or apparatus generally operable to receive and transmit data to or from or within the information handling system. An I/O subsystem may represent, for example, a variety of communication interfaces, graphics interfaces, video interfaces, user input interfaces, and peripheral interfaces. In various embodiments, components of an I/O subsystem may be used to support various peripheral devices, such as a touch panel, a display adapter, a keyboard, a touch pad, or a camera, among other examples. In some implementations, an I/O subsystem may support so-called 'plug and play' connectivity to external devices, in which the external devices may be added or removed while information handling system is operating.

A local storage resource may comprise computer-readable media (e.g., hard disk drive, floppy disk drive, CD-ROM, and other type of rotating storage media, flash memory, EEPROM, or another type of solid-state storage media) and may be generally operable to store instructions and data.

A network interface may be a suitable system, apparatus, or device operable to serve as an interface between an information handling system and a network (not shown). Components of a network interface may enable an information handling system to communicate over a network using a suitable transmission protocol or standard. In some embodiments, a network interface may be communicatively coupled via a network to a network storage resource (not shown). A network coupled to a network interface may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and messages (generally referred to as data). A network coupled to a network interface may transmit data using a desired storage or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), or any combination thereof. A network coupled to a network interface or various components associated therewith may be implemented using hardware, software, or any combination thereof.

Particular embodiments are best understood by reference to FIGS. 1, 2A-2B, 3, 4, 5A-5B, 6, 7A-7B, 8A-8B, 9A-9B and 10A-10B, wherein like numbers are used to indicate like and corresponding parts.

Turning to the drawings, FIG. 1 depicts a top view of printed circuit board assembly (PCA) 10 comprising two PCBs 14 connected with traditional compression connectors 18 including flex jumper cables. Each PCB 14 supports and provides power and communication for various components 12. PCB 14-1 may be referred to as a "main PCB" or "motherboard" and supports components 12-1 and 12-3. PCB 14-2 may be referred to as a "daughter PCB" or "daughterboard" and supports components 12-2, 12-4 and 12-5. Compression connectors 18 connect PCBS 14-1 and 14-2 to enable communication with components 12 on each PCB 14.

Figure 2A:
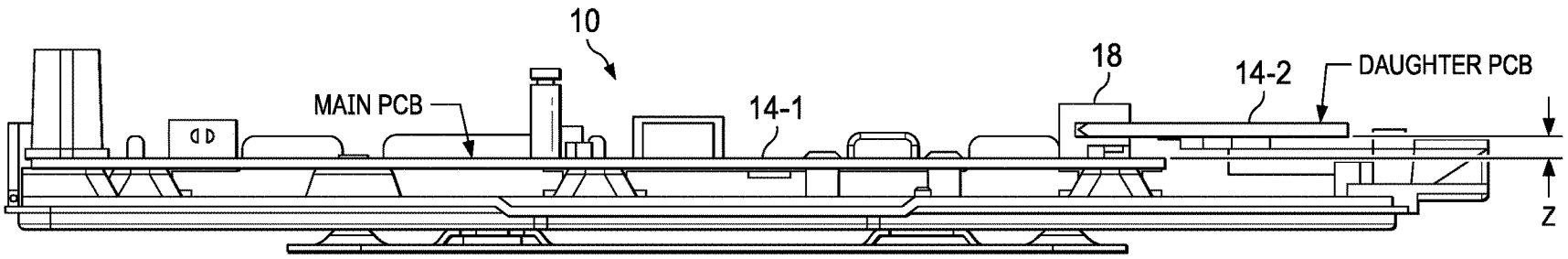
FIG. 2A is a side partial view of a dock motherboard, illustrating an offset resulting from a compression connector.
Figure 2B:
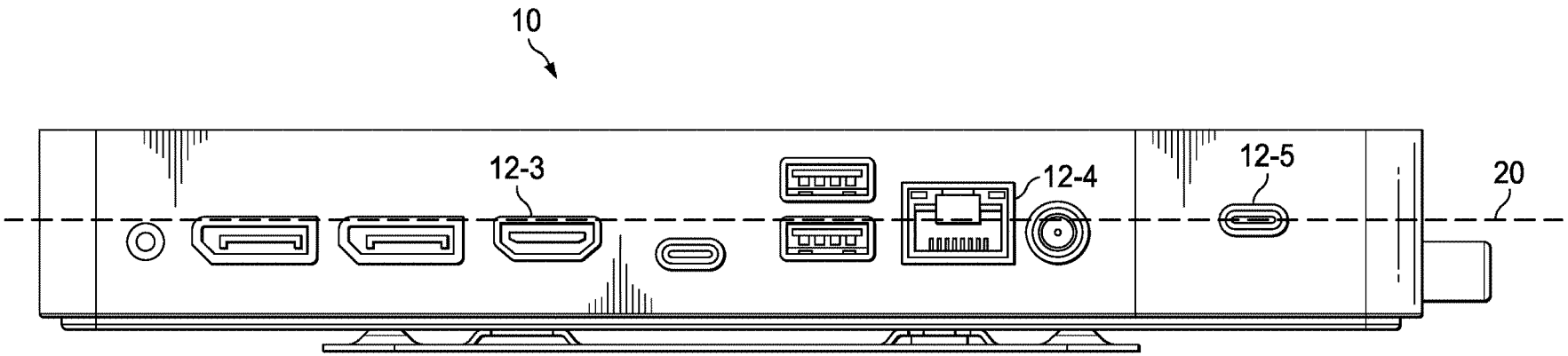
FIG. 2B is a side view of a chassis of a dock system, illustrating non-aligned I/O ports resulting from an offset associated with compression connectors.

Referring to one or more of FIG. 1 and FIGS. 2A and 2B, each PCB 14 may be formed with a particular shape based on other components 12 in an information handling system, relationships between components 12, manufacturing processes, and/or the dimensions of chassis 4 containing the information handling system. For example, PCA 10 may be installed between fans (not shown) in chassis 4 and PCB 14-1 may be formed with a shape to accommodate a fan housing. As another example, components 12 on PCB 14-2 may need to be isolated from components 12 on PCB 14-1, which may be due to thermal, power or acoustic constraints. As another example, PCB 14-1 may be manufactured by a first vendor and PCB 14-2 may be manufactured by a second vendor. Based on any of these and the dimensions of chassis 4, PCA 10 formed with a single PCB 14 might not fit or might not be feasible.

Compression Connectors Result in Overlap and Offset

Referring to FIGS. 2A and 2B, compression connectors 18 connect two PCBs 14 to form PCA 10 but the design of compression connectors 18 (and/or flex jumper cables connecting two compression connectors 18) results in a portion of PCB 14-2 overlapping a portion of PCB 14-1 with an offset of height Z. Regarding overlap, ideally all space on each PCB 14 is available for either installing a component 12 or providing circuit paths. Using a compression connector 18 reduces some of the available space on each PCB 14. Regarding offset, the height Z due to the dimensions of compression connectors 18 (and/or flex jumper cables) may affect airflow through chassis 4 but also affects the appearance of chassis 4. As depicted in FIG. 2B, the positions of I/O port 12-3 (which may be an HDMI cable port for example), I/O port 12-4 (which may be an Ethernet port, for example) and power input 12-5 are not aligned with midline 20 of chassis 4. The asymmetry of ports 12 relative to midline 20 may be unpleasing to a user.

Embodiments disclosed herein include an edge connector for connecting two printed circuit boards (PCBs) to form a printed circuit board assembly (PCA) such that the two PCBs are electrically and communicatively connected but may be thermally or otherwise isolated. An electrical connection may refer to the ability for electric power transfer between the two PCBs through the edge connector. A communication connection may refer to the ability for communication with a component on either PCB including the ability for components on the two PCBs to communicate with each other through the edge connector. A connection between an edge connector and a PCB may be based on the location of contact points on the PCB.

Referring to one or more of FIGS. 3, 4, 5A-5B, 6, 7A-7B, 8A-8B, 9A-9B and 10A-10B, embodiments disclosed herein include an edge-to-edge (or simply "edge") connector 100 for coupling two PCBs 14 to form a PCA 10, wherein PCBs 14 are coplanar and minimal space is needed between the two PCBs 14. Furthermore, edge connectors 100 may allow more variations in component layout on each PCB 14, which may allow for better airflow through chassis 4 and may allow chassis 4 to have a more pleasing appearance to a user.

Figure 3:
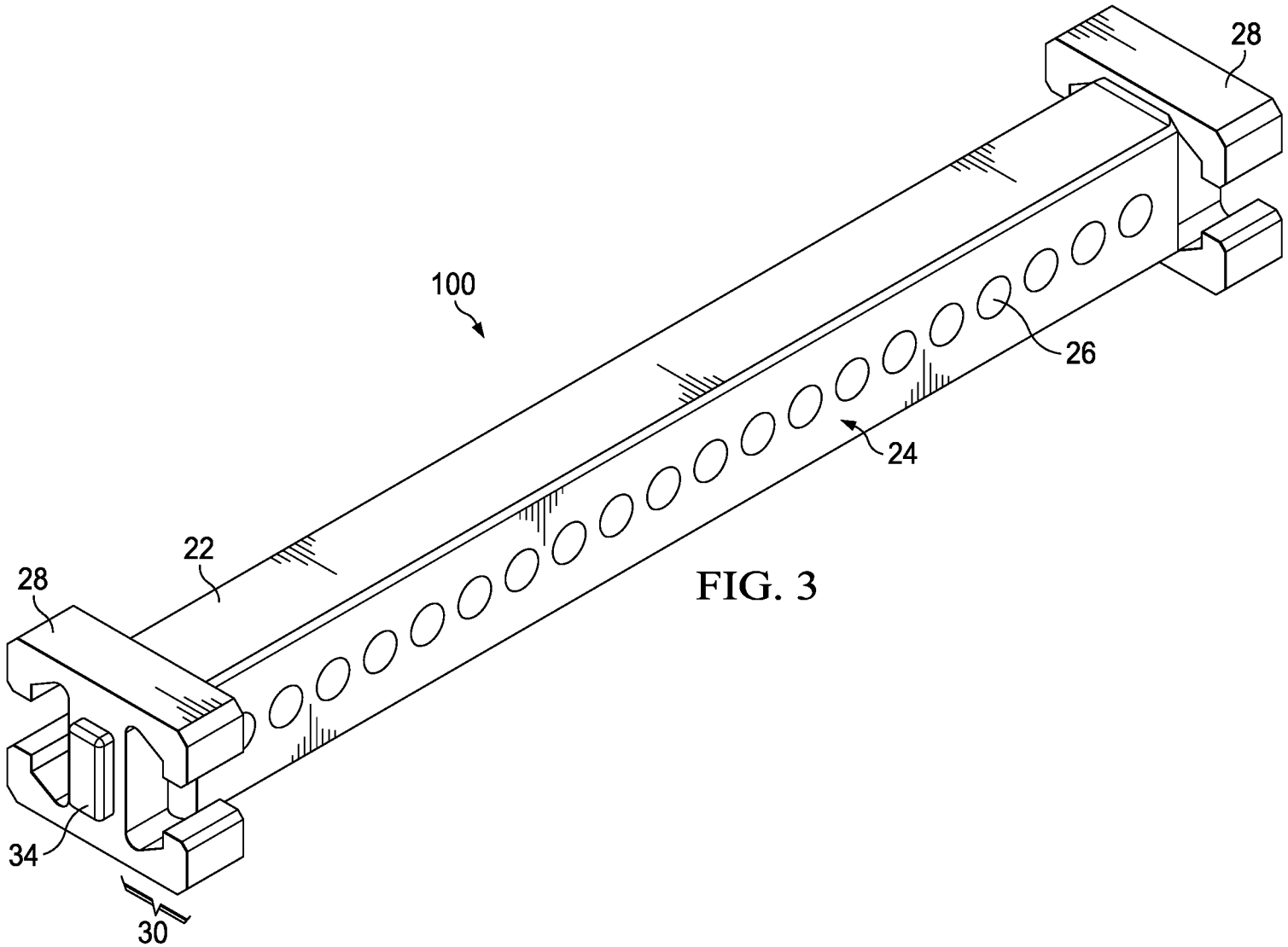
FIG. 3 is a perspective view of one embodiment of an edge connector for coplanar coupling of two PCBs to form a PCA.
Figure 4:
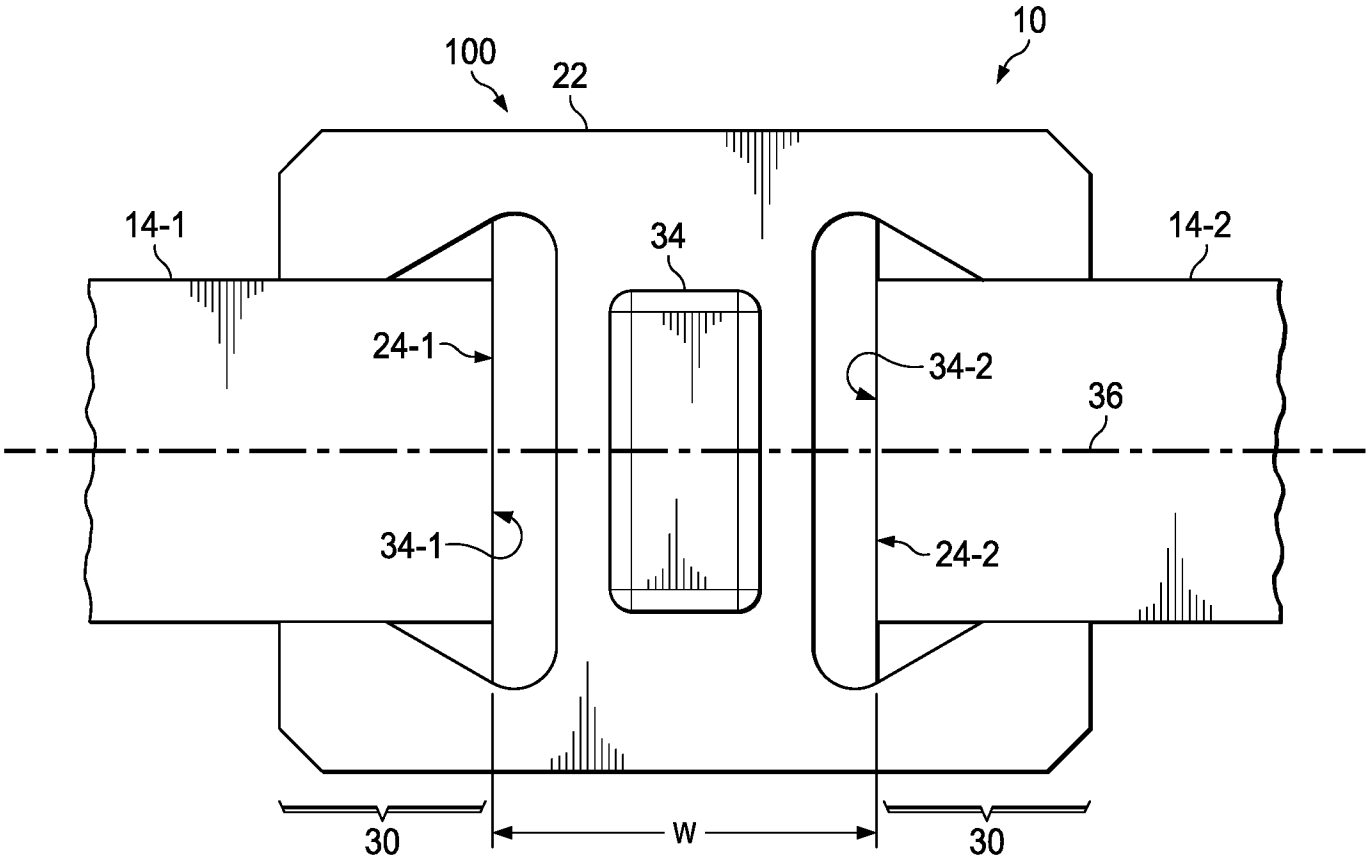
FIG. 4 is a close-up partial end view of a PCA, illustrating two PCBs coupled with one embodiment of an edge connector.

Referring to FIGS. 3, 4 and 5A-5B, some embodiments of edge connector 100 comprise elongated body 22 with PCB contact surfaces 24 and end structures 28 for the coplanar coupling of two PCBs 14 to form a PCA (discussed in greater detail with respect to FIG. 4). End structures 28 coupled to elongated body 22 comprise contact pairs with top contacts 30 and bottom contacts 30 for engaging PCBs 14 (discussed in greater detail with respect to FIG. 5) and may include end alignment features 34 for positioning two or more edge connectors 100 end-to-end. A plurality of contact positions 26 in each PCB contact surface 24 enable coplanar connections between two PCBs 14 (discussed in greater detail with respect to FIGS. 6A and 6B).

Edge Connector Forms PCA with Two Coplanar PCBS

Referring to FIGS. 3 and 4, PCBs 14 may be coupled to edge connector 100 such that edge surface 34-1 of PCB 14-1 is seated against first PCB contact surface 24-1 of elongated body 22 and edge surface 34-2 of PCB 14-2 is seated against second PCB contact surface 24-2 of elongated body 22 to form PCA 10 with PCB 14-1 coplanar with PCB 14-2 (aligned with line 36). As illustrated in FIG. 4, the design of edge connector 100 results in no overlap of PCBs 14 or offset between PCBs 14. In some embodiments, the overall size of PCA 10 may be increased only by width (W) of elongated body 22. Embodiments may include contact pairs of top and bottom contacts 30 extending laterally from elongated body 22 to engage PCBs 14. However, the dimensions of end structures 28 and top and bottom contacts 30 are small relative to the length of elongated body 22 such that top and bottom contacts 30 require little space on each PCB 14.

Contact Pairs Engage PCBS to Maintain Secure Coplanar Coupling

Figure 5:
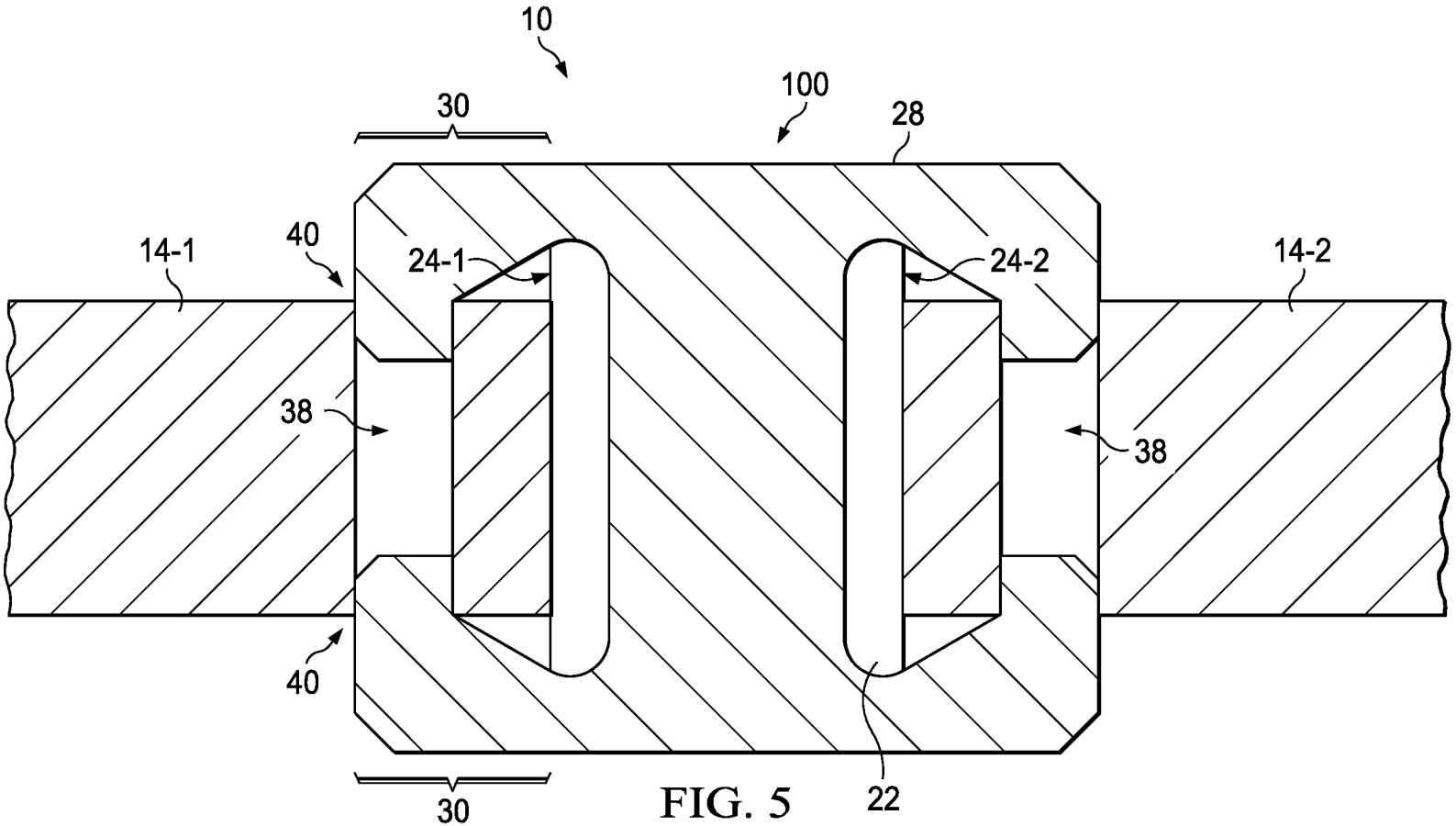
FIG. 5 depicts a cutaway end view of one embodiment of an edge connector, illustrating connection features for engaging PCBs.

Referring to FIG. 5, embodiments of edge connector 100 may include end structures 28 with contact pairs comprising contacts 30. For ease of understanding, contacts 30 may be referred to herein as top contacts 30 and bottom contacts 30 based on the depiction in the accompanying figures. However, embodiments may be oriented in any direction. Top contacts 30 and bottom contacts 30 may extend laterally outward of PCB contact surfaces 24 of elongated body 22 for coupling to PCBs 14.

First Contact Pairs Couple Edge Connector to First PCB

A top contact 30 extending in a first direction from first end structure 28 and a top contact 30 extending in the first direction from second end structure 28 are configured for contact with a first surface of a first PCB 14-1. A bottom contact 30 extending in the first direction from first end structure 28 and a bottom contact 30 extending in the first direction from second end structure 28 are configured for contact with a second surface of the first PCB 14-1 opposite the first surface of the first PCB 14-1. The top contact 30 on first end structure 28 and the bottom contact 30 on first end structure 28 form a first contact pair on first end structure 28. The top contact 30 on second end structure 28 and the bottom contact 30 on second end structure 28 form a first contact pair on second end structure 28. The first contact pair on the first end structure 28 and the first contact pair on second end structure 28 couple edge connector 100 to first PCB 14-1.

Second Contact Pairs Couple Edge Connector to Second PCB

A top contact 30 extending in a second direction from first end structure 28 and a top contact 30 extending in the second direction from second end structure 28 are configured for contact with the first surface of second PCB 14-2. A bottom contact 30 extending in the second direction from first end structure 28 and a bottom contact 30 extending in the second direction from second end structure 28 are configured for contact with a second surface of the second PCB 14-2 opposite the first surface of second PCB 14-2. The top contact 30 extending in the second direction from first end structure 28 and the bottom contact 30 extending in the second direction from first end structure 28 form a second contact pair on first end structure 28. The top contact 30 extending in the second direction from second end structure 28 and the bottom contact 30 extending in the second direction from second end structure 28 form a second contact pair on second end structure 28. The second contact pair on first end structure 28 and the second contact pair on second end structure 28 couple edge connector 100 to second PCB 14-2. In some embodiments, top and bottom contacts 30 are separated by a gap less than a thickness of a PCB 14, wherein each contact 30 is formed with resilient material to couple PCBs 14 to edge connector 100 with edge surface 34 against PCB contact surfaces 24 by a spring force associated with the resilient material. In some embodiments, each contact 30 comprises engaging features 40 for retaining PCB 14 in edge connector 100 with edge surface 34 against a side surface 24. In some embodiments, PCBs 14 may be formed with receivers 38 in a first surface and second surface of PCB 14 for engagement by engaging features 40. As depicted in FIG. 5, receivers 38 may be recesses including through-holes, detents or otherwise formed from material removal from PCBs 14. In other embodiments (not shown), a receiver 38 may be a lip, pall or otherwise formed by adding material to other surfaces of PCBs 14. Once PCBs 14 are positioned with end surfaces 34 seated against PCB contact surfaces 24 of elongated body 22, engaging features 40 and receivers 38 maintain the coplanar coupling and ensure PCBs 14 are electrically and communicatively connected.

Compression Contacts Form Conduction Paths Connecting Two PCBS

Figure 6B:
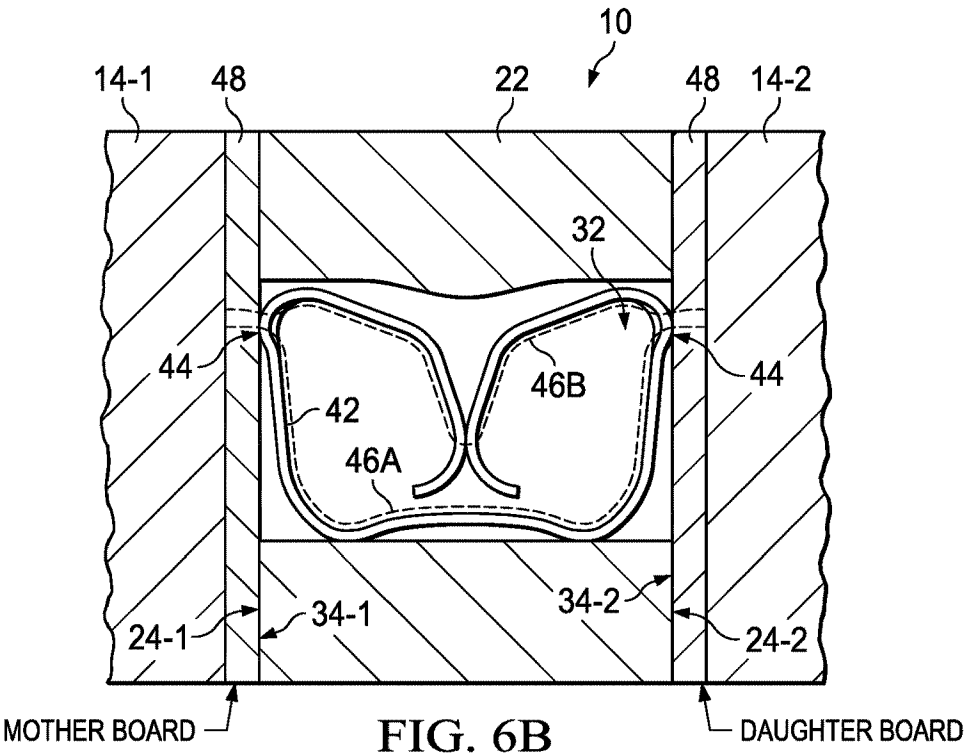
FIG. 6B depicts a cutaway end view of the embodiment of an edge connector depicted in FIG. 6A connecting two PCBs, illustrating the compression contact positioned in the inner compartment of the edge connector, wherein the compression contact in a compressed state electrically connects the two PCBs.
Figure 6A:
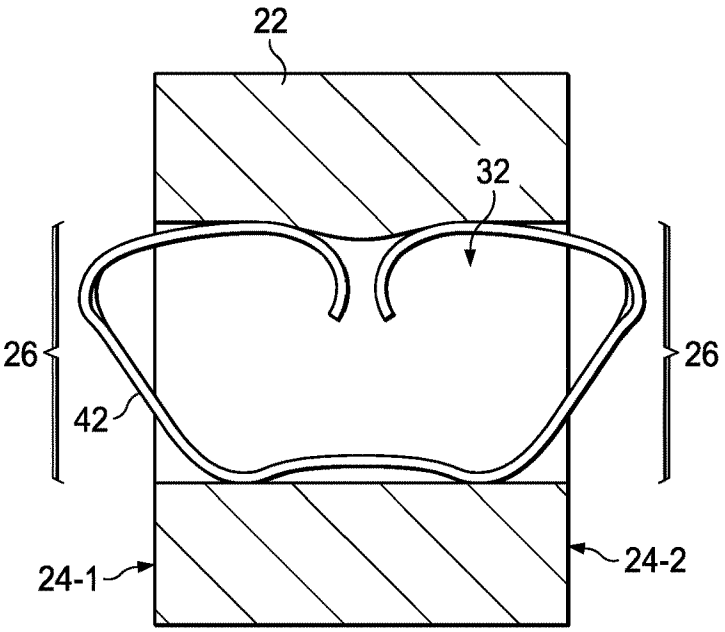
FIG. 6A depicts a cutaway end view of one embodiment of an edge connector, illustrating a compression contact positioned in a compression contact space of an edge connector, wherein the compression contact is in an uncompressed state.

Referring to FIGS. 3 and 6A and 6B, elongated body 22 comprises compression contact space 32 comprising a plurality of resilient compression contacts 42. As depicted in FIG. 6A, in an uncompressed state, portions of compression contacts 42 may extend out of contact positions 26 in both PCB contact surfaces 24-1 and 24-2. As depicted in FIG. 6B, when PCBs 14 are coupled with edge connector 100 to form PCA 10, edge surfaces 34 of PCBs 14 are seated against PCB contact surfaces 24 of elongated body 22. Edge surfaces 34 seated against side surfaces 24 causes contact between compression contacts 42 at contact points 44, forming one or more conduction paths 46 between PCB 14-1 and PCB 14-2. As depicted in FIG. 6B, each compression contact 42 forms a first conduction path 46A between PCB 14-1 and PCB 14-2. Also depicted in FIG. 6B, in some embodiments, each compression contact 42 may form a second conduction path 46B between two contact points 44 if the compression of compression contact 42 causes the ends to touch. In some embodiments, compression contacts 42 may be pin springs.

Edge Connections Form Contact Points

Still referring to FIGS. 6A and 6B, edge surfaces 34 of PCBs 14 may be configured with edge connections 48 for contact with compression contacts 42 at contact points 44 between PCBs 14 and elongated body 22. In some embodiments, a plurality of castellated holes are formed in a PCB 14 and each castellated hole is modified to form a substantially flat edge connection 48. In some embodiments, a castellated hole is formed from a via extending from a first surface (e.g., a top surface) of a PCB 14 to a second surface (e.g., a bottom surface) opposite the first surface to form an edge connection 48. The castellated holes may be modified by filling in a portion of the castellated hole with a conductive material, then machining edge surface 34 (with the modified edge connections 48) substantially flat. The edge surface may then be coated with gold flash or hard gold or other finishing materials to provide a suitable edge connection 48 for contact with a compression contact 42.

End-to-End Positioning of Edge Connectors

Figure 7B:
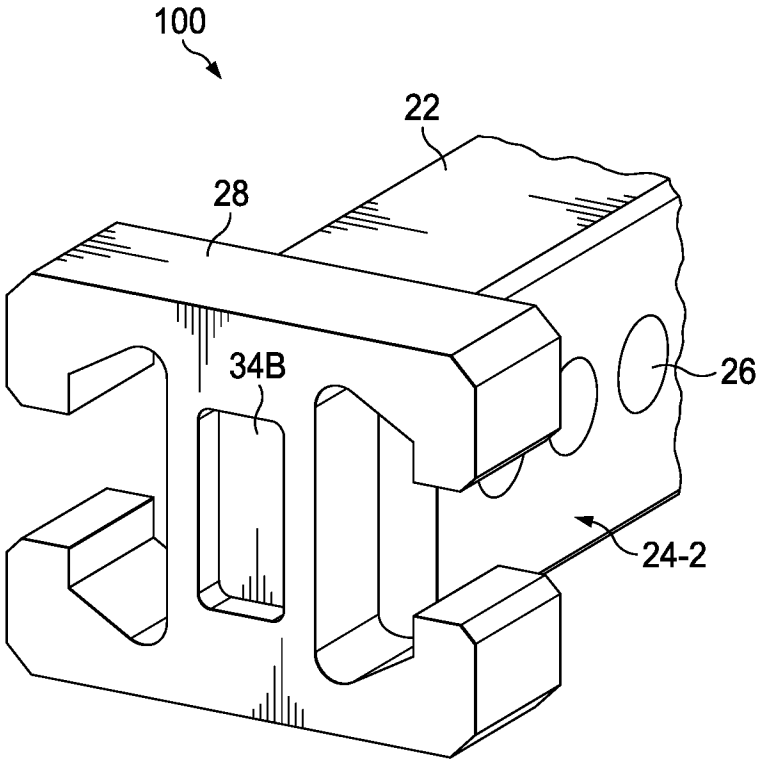
FIGS. 7A and 7B depict perspective end views of one embodiment of an edge connector, illustrating complementary alignment features for positioning edge connectors end-to-end.
Figure 7A:
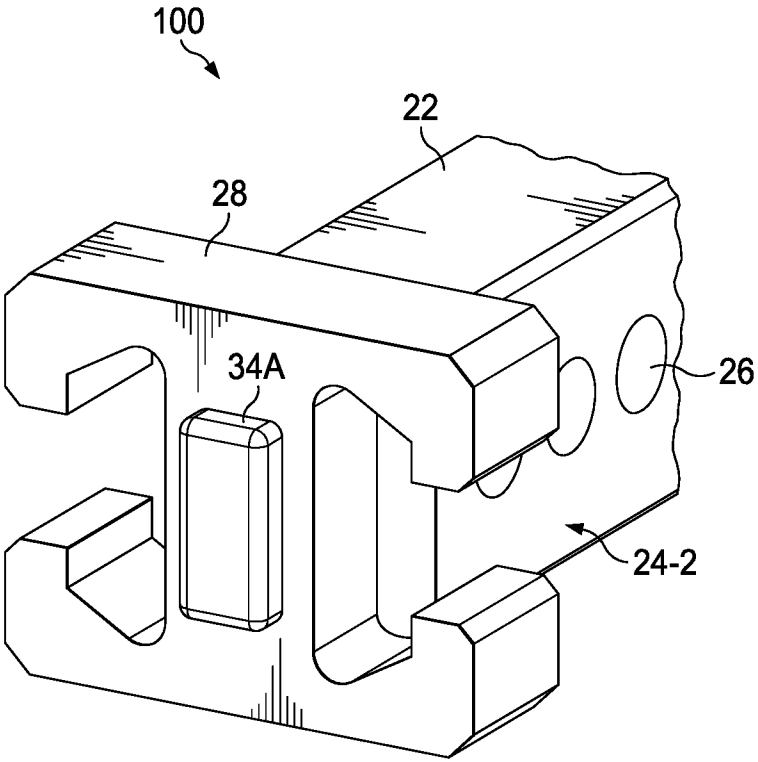

Referring to FIGS. 1 and 7A-7B, embodiments of edge connector 100 may be configured with end alignment features 34 to accommodate end-to-end positioning or coupling of two or more edge connectors 100. As depicted in FIGS. 7A and 7B, a first end structure 28 of edge connector 100 may comprise end alignment feature 34A and a second end structure 28 of edge connector 100 may comprise complementary end alignment features 34B. End alignment features 34 may allow two edge connectors 100 to be assembled into a single unit before coupling to a PCB 14 or allow each edge connector 100 to be independently coupled to a PCB 14.

Figure 8A:
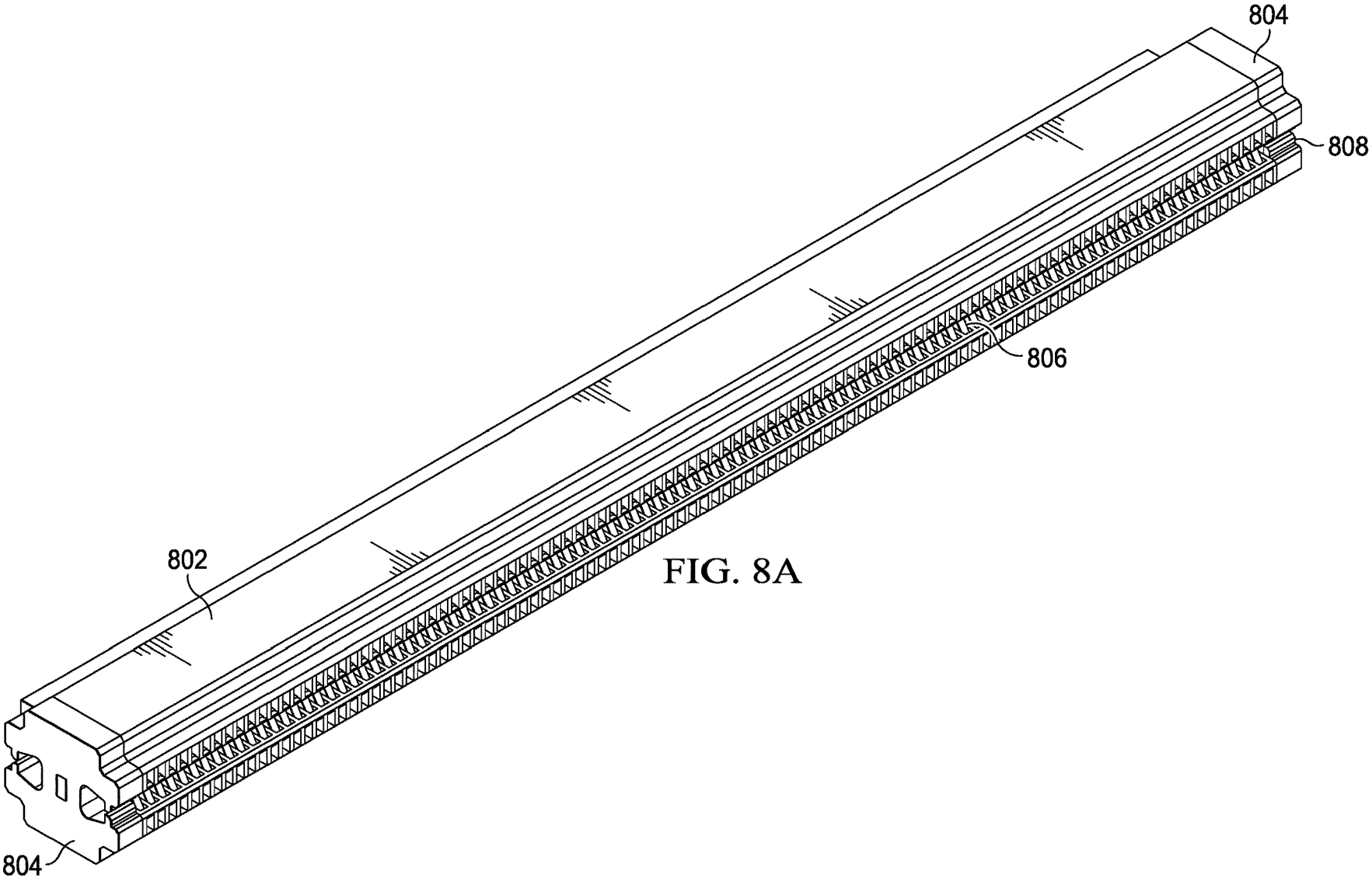
FIGS. 8A and 8B depict a cutaway end view and a perspective view, respectively, of an alternate embodiment of an edge connector.
Figure 8B:
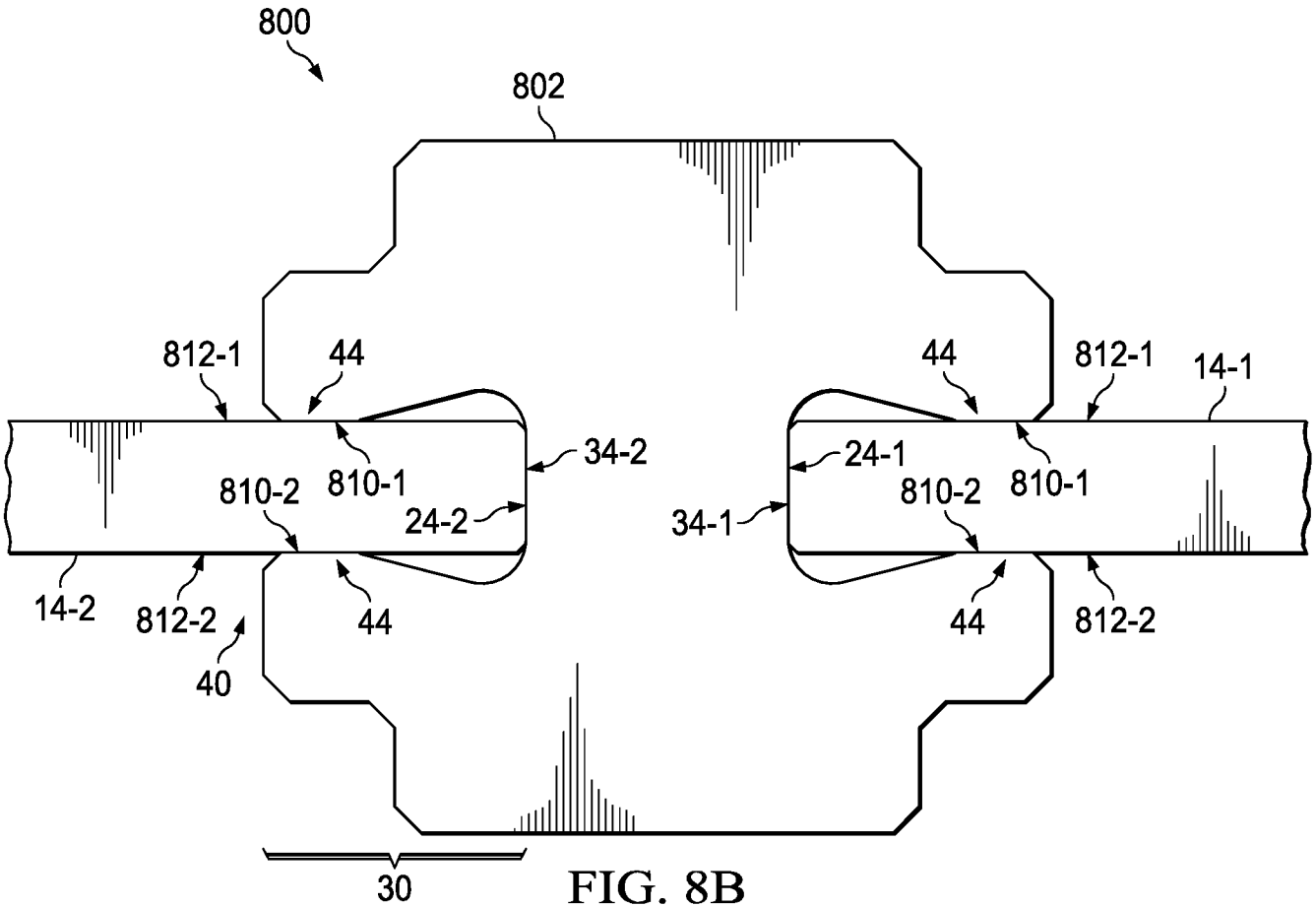

Referring to FIGS. 8A and 8B, in some embodiments, an alternate embodiment of a system for coupling two PCBs 14 into a PCA 10 comprises edge connector 800 with elongated body 802 configured for coplanar coupling of two PCBs 14, in which edge surfaces 34 of PCBs 14 might not have edge connections 48. Referring to FIG. 8A, elongated body 802 has ends 804 configured with top and bottom contacts 30 having engaging features 808 for coupling to PCBs 14.

Compression contacts 806 may extend from PCB contact surfaces 810 to form contact points 44. Referring to FIG. 8B, when PCBs 14 are coupled to edge connector 800, portions of compression contacts 806 may form contact points 44 between PCB contact surfaces 810 and PCB surfaces 812 (e.g., first surface 812-1 and second surface 812-2 of PCBs 14). Edge connector 800 may enable electrical connections some distance from the edge surface 34 of a PCB 14 and may also provide a lower overall height at contact points 44. In some embodiments, top and bottom contacts 30 may determine the distance from the edge surface 34 of PCB 14 that an electrical connection may be formed.

Assembling a PCA with PCBS Using Edge Connectors

Figure 9A:
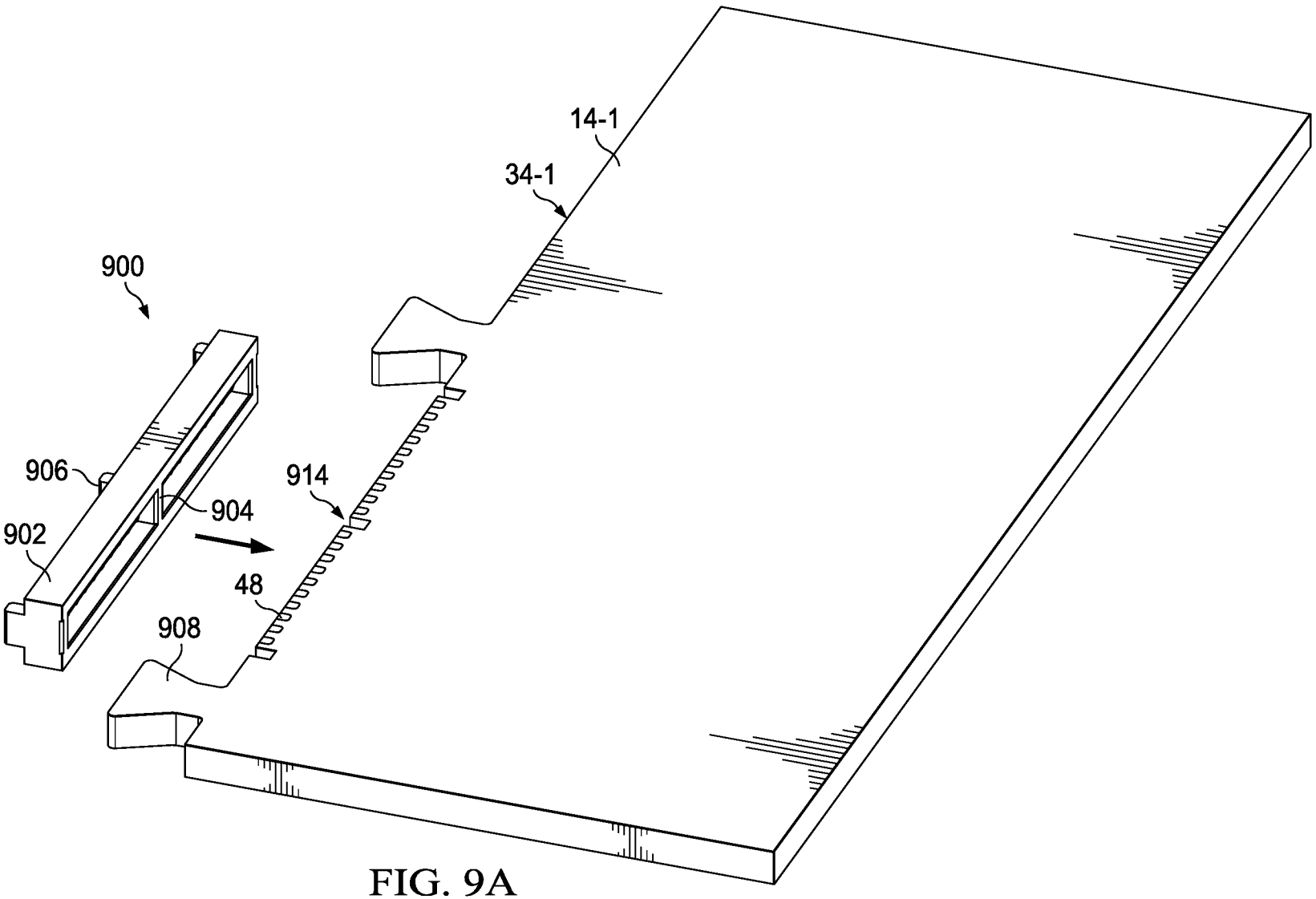
FIG. 9A depicts a perspective view of one embodiment of an edge connector and a first PCB, illustrating alignment and positioning of an edge connector on a PCB for assembling a PCA.

Referring to FIGS. 9A and 9B and 10A and 10B, embodiments enable coplanar coupling of PCBs 14 to form PCA 10, wherein PCBs 14 may be electrically and/or communicatively connected and may also be isolated. As depicted in FIG. 9A, embodiments of edge connector 900 may comprise elongated body 902 and may include PCB alignment features 904. Edge surface 34-1 of PCB 14-1 may be substantially flat with a plurality of edge connections 48. PCB 14-1 may be configured with top and bottom contacts 908 and notch 914 for aligning PCB 14-1 with elongated body 902.

Figure 9B:
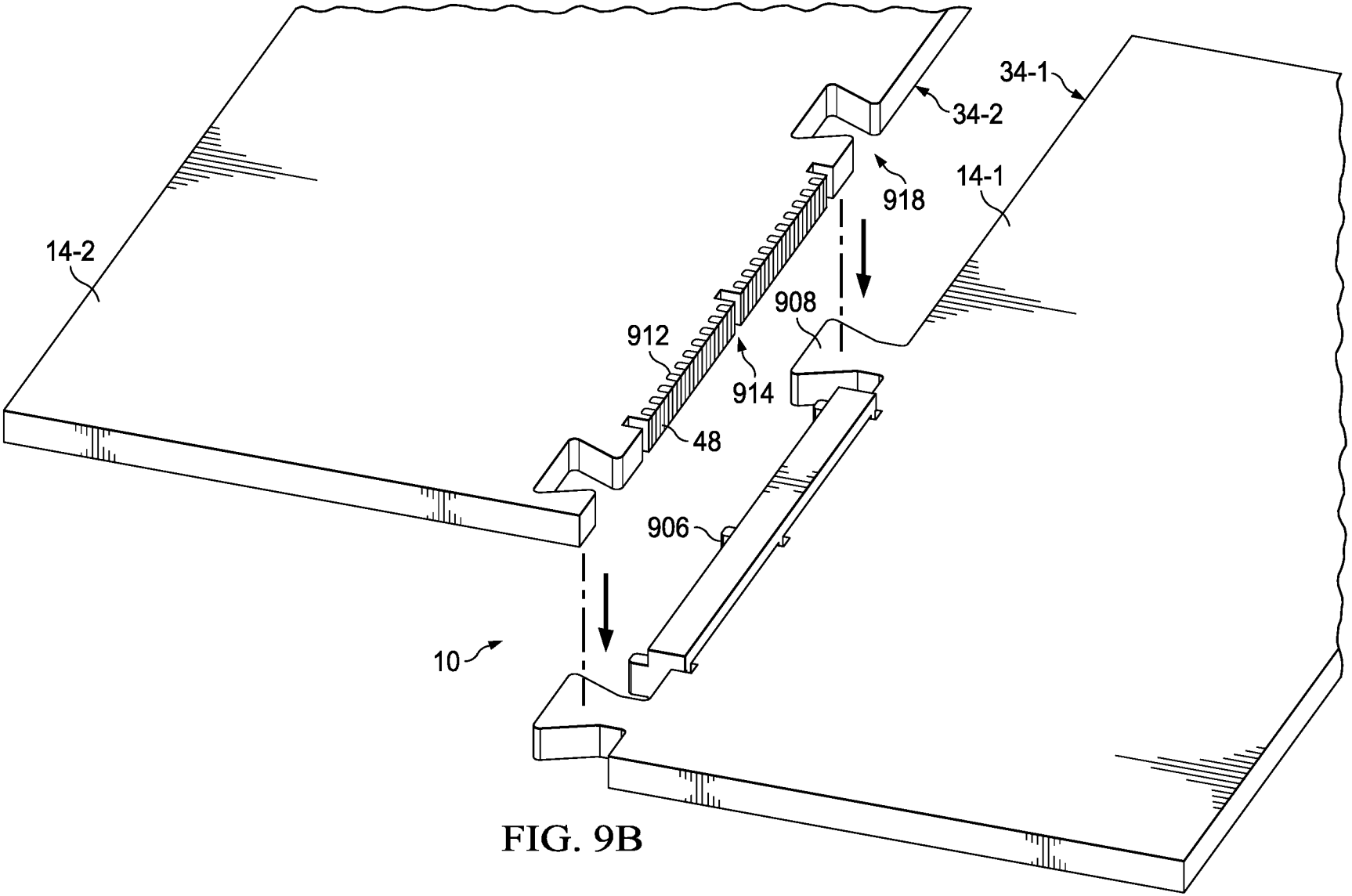
FIG. 9B depicts a perspective view of the edge connector and first PCB of FIG. 9A and a second PCB, illustrating alignment and positioning of two PCBs to form a PCA.
Figure 10A:
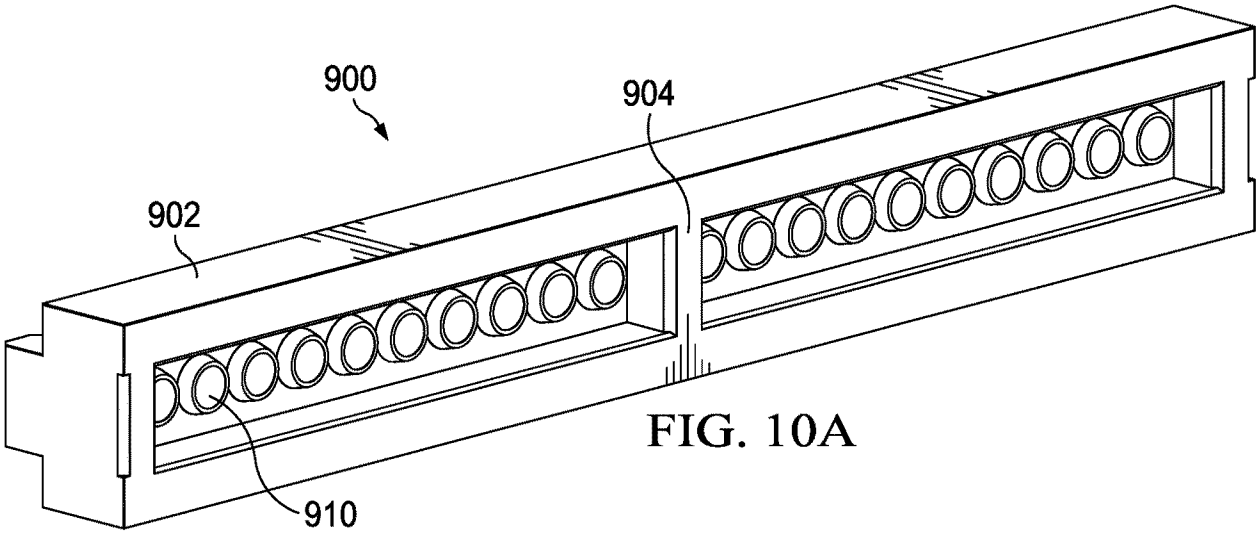
FIGS. 10A and 10B depict perspective views of an alternate embodiment of an edge connector.
Figure 10B:
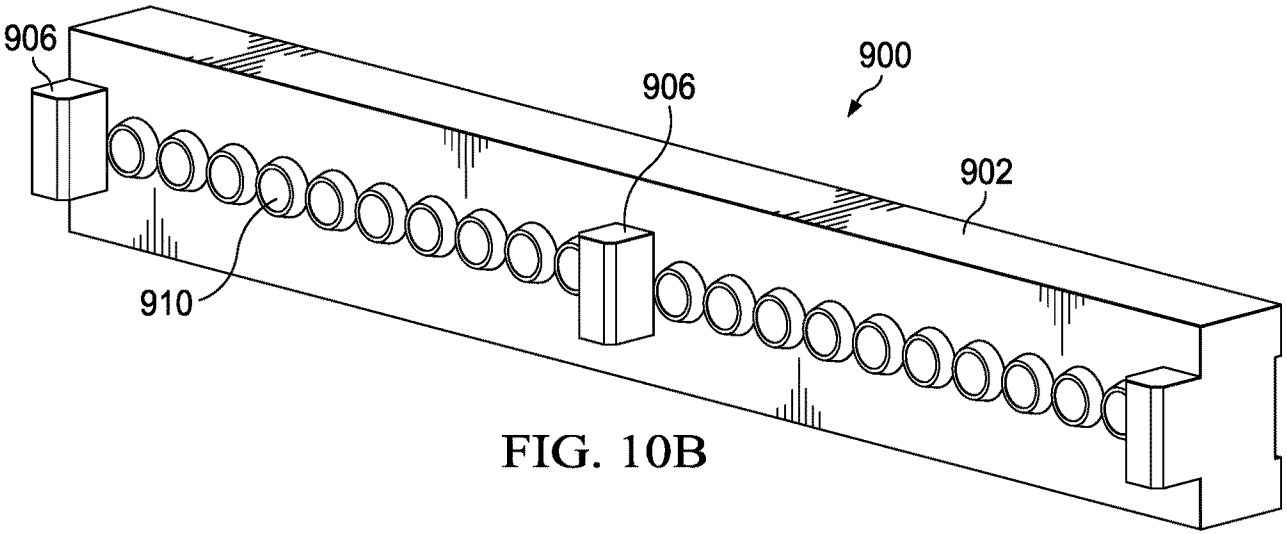

As depicted in FIG. 9B, PCB receiving features 918 on second PCB 14-2 may be positioned relative to PCB extensions 908 on first PCB 14-1 to couple PCB 14-1 with PCB 14-2. Notch 914 on second PCB 14-2 may be aligned with alignment feature 906 on elongated body 902 such that electrical and or signal connections are formed between edge connections 48 on PCBs 14, wherein PCBs 14-1 and 14-2 may be electrically connected but isolated.

Advantageously, edge connectors 100 may enable a manufacturer of information handling systems to design and assemble more variations of PCAs 10. For example, if a manufacturer needs a PCA 10 to have a shape similar to the shape of PCA 10 in FIG. 1, manufacturing PCA 10 from a single piece of material will result in a significant amount of the material being scrapped. Alternatively, embodiments disclosed herein allow a manufacturer to couple smaller PCBs 14 into a PCA 10 similar to the shape of PCA 10 in FIG. 1, wherein each piece of material may contain multiple (smaller) PCBs 14 and the number, position and orientation of each (smaller) PCB 14 may be selected to minimize the amount of scrapped material. Embodiments also enable a manufacturer to isolate PCBs 14 or components 12. Isolation may include thermal isolation, vibration isolation, acoustic isolation, and isolation from other issues. Embodiments may also enable a manufacturer to assemble an information handling system based on the dimensions of chassis 4 and airflow through chassis 4.

The above disclosed subject matter is to be considered illustrative, and not restrictive, and the appended claims are intended to cover all such modifications, enhancements, and other embodiments which fall within the true spirit and scope of the disclosure. Thus, to the maximum extent allowed by law, the scope of the disclosure is to be determined by the broadest permissible interpretation of the following claims and their equivalents, and shall not be restricted or limited by the foregoing detailed description.

What is claimed is:

1. An edge connector for coplanar coupling of two printed circuit boards (PCBs) into a printed circuit board assembly (PCA), the edge connector comprising:

an elongated body comprising:

a compression contact space;

two PCB contact surfaces, wherein a first PCB contact surface is opposite a second PCB contact surface; and a plurality of contact positions, wherein a first set of the plurality of contact positions is on the first PCB contact surface and a second set of the plurality of contact positions is on the second PCB contact surface;

a plurality of compression contacts positioned in the compression contact space, wherein each compression contact comprises conductive material and is configured with a first portion that extends through a contact position of the first set of contact positions and a second portion that extends through a contact position of the second set of contact positions;

a first end structure on a first end of the elongated body; and a second end structure on a second end of the elongated body, wherein a top contact extending in a first direction from the first end structure and a top contact extending in the first direction from the second end structure are configured for contact with a first surface of a first PCB; and a bottom contact extending in the first direction from the first end structure and a bottom contact extending in the first direction from the second end structure are configured for contact with a second surface of the first PCB opposite the first surface of the first PCB, wherein the top contact on the first end structure and the bottom contact on the first end structure form a first contact pair on the first end structure, the top contact on the second end structure and the bottom contact on the second end structure form a first contact pair on the second end structure, and the first contact pair on the first end structure and the first contact pair on the second end structure couple the edge connector to the first PCB;

a top contact extending in a second direction from the first end structure and a top contact extending in the second direction from the second end structure are configured for contact with a first surface of a second PCB; and a bottom contact extending in the second direction from the first end structure and a bottom contact extending in the second direction from the second end structure are configured for contact with a second surface of the second PCB opposite the first surface of the second PCB, wherein the top contact extending in the second direction from the first end structure and the bottom contact extending in the second direction from the first end structure form a second contact pair on the first end structure, the top contact extending in the second direction from the second end structure and the bottom contact extending in the second direction from the second end structure form a second contact pair on the second end structure, and the second contact pair on the first end structure and the second contact pair on the second end structure couple the edge connector to the second PCB.

2. The edge connector of claim 1, wherein each compression contact comprises a pin spring.

3. The edge connector of claim 1, wherein the top contact of the first contact pair is separated from the bottom contact of the first contact pair by a distance less than a thickness of the first PCB, wherein a spring force associated with each of the top contact of the first contact pair and the bottom contact of the first contact pair couples the edge connector to the first PCB.

4. The edge connector of claim 1, wherein the top contact of the first contact pair comprises an engaging feature for coupling to a receiver in the first surface of the first PCB and the bottom contact of the first contact pair comprises an engaging feature for coupling to a receiver in the second surface of the first PCB.

5. The edge connector of claim 4, wherein:

the receiver in the first surface of the first PCB comprises a first recess;

the receiver in the second surface of the first PCB comprises a second recess;

the top contact of the first contact pair is configured for positioning the engaging feature of the top contact in the first recess; and the bottom contact of the first contact pair is configured for positioning the engaging feature of the bottom contact in the second recess.

6. The edge connector of claim 4, wherein:

the first PCB comprises a through-hole forming the receiver in the first surface of the first PCB and the receiver in the second surface of the first PCB;

the top contact of the first contact pair is configured for positioning the engaging feature of the top contact in the through-hole; and the bottom contact of the first contact pair is configured for positioning the engaging feature of the bottom contact in the through-hole.

7. A method for coplanar coupling of two printed circuit boards (PCBs) into a printed circuit board assembly (PCA), the method comprising:

positioning a plurality of resilient edge connectors in a compression contact space in an elongated body of an edge connector, the elongated body further comprising:

a first PCB contact surface and a second PCB contact surface opposite the first PCB contact surface; and a plurality of contact positions, wherein a first set of the plurality of contact positions is on the first PCB contact surface and a second set of the plurality of contact positions is on the second PCB contact surface, wherein each compression contact comprises conductive material and is configured with a first portion that extends through a contact position of the first set of contact positions and a second portion that extends through a contact position of the second set of contact positions;

positioning an edge connector with a first PCB contact surface of the elongated body in contact with an edge surface of a first PCB, wherein the first portion of each compression contact extending through the contact position of the first set of contact positions contacts an edge connection on the edge surface of the first PCB;

coupling a first contact pair on a first end structure of the edge connector and a first contact pair on a second end connector to the first PCB, wherein the first contact pair on the first end structure comprises a top contact extending from the first end structure in a first direction and configured for contact with a first surface of the first PCB and a bottom contact extending from the first end structure in the first direction and configured for contact with a second surface of the first PCB; and the first contact pair on the second end structure comprises a top contact extending from the second end structure in the first direction and configured for contact with the first surface of the first PCB and a bottom contact extending from the second end structure in the first direction and configured for contact with the second surface of the first PCB;

positioning the edge connector with a second PCB contact surface of the elongated body in contact with an edge surface of a second PCB, wherein the second portion of each compression contact extending through a contact position of the second set of contact positions contacts an edge connection on the edge surface of the second PCB; and coupling a second contact pair on the first end structure of the edge connector and a second contact pair on the second end connector to the second PCB, wherein the second contact pair on the first end structure comprises a top contact extending from the first end structure in a second direction opposite the first direction and configured for contact with a first surface of the second PCB and a bottom contact extending from the first end structure in the second direction and configured for contact with the first surface of the second PCB; and the second contact pair on the second end structure of the edge connector comprises a top contact extending from the second end structure in the second direction and configured for contact with the first surface of the second PCB and a bottom contact extending from the second end structure in the second direction and configured for contact with the second surface of the second PCB.

8. The method of claim 7, wherein each compression contact comprises a pin spring.

9. The method of claim 7, wherein the top contact of the first contact pair is separated from the bottom contact of the first contact pair by a distance less than a thickness of the first PCB, wherein a spring force associated with each of the top contact of the first contact pair and the bottom contact of the first contact pair couples the edge connector to the first PCB.

10. The method of claim 7, wherein the top contact of the first contact pair comprises an engaging feature for coupling to a receiver in the first surface of the first PCB and the bottom contact of the first contact pair comprises an engaging feature for coupling to a receiver in the second surface of the first PCB.

11. The method of claim 10, wherein:

the receiver in the first surface of the first PCB comprises a first recess;

the receiver in the second surface of the first PCB comprises a second recess;

coupling the first contact pair comprises positioning the engaging feature of the top contact of the first contact pair in the first recess and positioning the engaging feature of the bottom contact of the first contact pair in the second recess.

12. The method of claim 10, wherein:

the first PCB comprises a through-hole forming the receiver in the first surface of the first PCB and the receiver in the second surface of the first PCB; and coupling the first contact pair comprises positioning the engaging feature of the top contact of the first contact pair in the through-hole and positioning the engaging feature of the bottom contact of the first contact pair in the through-hole.

13. A printed circuit board assembly (PCA) comprising:

two first printed circuit boards (PCBs), each PCB having a first surface, a second surface opposite the first surface and an edge surface; and an edge connector coupling the two PCBs to form the PCA, the edge connector comprising:

an elongated body comprising:

a compression contact space;

two PCB contact surfaces, wherein a first PCB contact surface is opposite a second PCB contact surface; and a plurality of contact positions, wherein a first set of the plurality of contact positions is on the first PCB contact surface and a second set of the plurality of contact positions is on the second PCB contact surface;

a plurality of compression contacts positioned in the inner compartment, wherein each compression contact comprises conductive material and is configured with a first portion that extends through a contact position of the first set of contact positions and a second portion that extends through a contact position of the second set of contact positions; and a first end structure on a first end of the elongated body; and a second end structure on a second end of the elongated body, wherein a top contact extending in a first direction from the first end structure and a top contact extending in the first direction from the second end structure are configured for contact with the first surface of the first PCB; and a bottom contact extending in the first direction from the first end structure and a bottom contact extending in the first direction from the second end structure are configured for contact with the second surface of the first PCB opposite the first surface of the first PCB, wherein the top contact on the first end structure and the bottom contact on the first end structure form a first contact pair on the first end structure, the top contact on the second end structure and the bottom contact on the second end structure form a first contact pair on the second end structure, and the first contact pair on the first end structure and the first contact pair on the second end structure couple the edge connector to the first PCB;

a top contact extending in a second direction from the first end structure and a top contact extending in the second direction from the second end structure are configured for contact with a first surface of the second PCB; and a bottom contact extending in the second direction from the first end structure and a bottom contact extending in the second direction from the second end structure are configured for contact with a second surface of the second PCB opposite the first surface of the second PCB, wherein the top contact extending in the second direction from the first end structure and the bottom contact extending in the second direction from the first end structure form a second contact pair on the first end structure, the top contact extending in the second direction from the second end structure and the bottom contact extending in the second direction from the second end structure form a second contact pair on the second end structure, and the second contact pair on the first end structure and the second contact pair on the second end structure couple the edge connector to the second PCB.

14. The PCA of claim 13, wherein each compression contact comprises a pin spring.

15. The PCA of claim 13, wherein the top contact of the first contact pair is separated from the bottom contact of the first contact pair by a distance less than a thickness of the first PCB, wherein a spring force associated with each of the top contact of the first contact pair and the bottom contact of the first contact pair couples the edge connector to the first PCB.

16. The PCA of claim 13, wherein the top contact of the first contact pair comprises an engaging feature for coupling to a receiver in the first surface of the first PCB and the bottom contact of the first contact pair comprises an engaging feature for coupling to a receiver in the second surface of the first PCB.

17. The PCA of claim 16, wherein:

the receiver in the first surface of the first PCB comprises a first recess;

the receiver in the second surface of the first PCB comprises a second recess;

the top contact of the first contact pair is configured for positioning the engaging feature of the top contact in the first recess; and the bottom contact of the first contact pair is configured for positioning the engaging feature of the bottom contact in the second recess.

18. The PCA of claim 16, wherein:

the first PCB comprises a through-hole forming the receiver in the first surface of the first PCB and the receiver in the second surface of the first PCB;

the top contact of the first contact pair is configured for positioning the engaging feature of the top contact of the first contact pair in the through-hole; and the bottom contact of the first contact pair is configured for positioning the engaging feature of the bottom contact of the first contact pair in the through-hole.

* * * * *